United States Patent [19]

Zimmern

[11] 4,321,022

[45] Mar. 23, 1982

[54] INTER-ENGAGING THREADED ROTOR AND PINION MACHINE WITH MULTI-EDGED PINION TOOTH FLANKS

[75] Inventor: Bernard Zimmern, Neuilly sur Seine, France

[73] Assignee: Uniscrew Limited, Hamilton, Bermuda

[21] Appl. No.: 93,444

[22] Filed: Nov. 13, 1979

[30] Foreign Application Priority Data

Dec. 13, 1978 [FR] France ..... 78 35104

[51] Int. Cl.[3] ..... F04C 18/00; F16H 1/16; F16H 55/08

[52] U.S. Cl. ..... 418/195; 74/425; 74/462

[58] Field of Search ..... 418/195; 74/425, 462

[56] References Cited

U.S. PATENT DOCUMENTS 1,791,047 2/1931 Symons ..... 418/195
2,058,230 10/1936 Hornbostel ..... 418/195
2,603,412 7/1952 Chilton ..... 418/195
3,788,784 1/1974 Zimmern ..... 418/195
3,932,077 1/1976 Zimmern ..... 418/195

FOREIGN PATENT DOCUMENTS 2141471 1/1973 France .

*Primary Examiner*—John J. Vrablik
*Attorney, Agent, or Firm*—Robert F. Ziems

[57] ABSTRACT

A compressor or expansion machine for fluids comprises a rotor, a casing at least partially surrounding the rotor and a pinion which is rotatable about an axis which is not parallel to the rotor axis. The rotor is provided with helical threads having crests which are disposed on a surface of revolution about the rotor axis and the pinion has teeth which engage between two adjacent threads of the rotor to form a compression or expansion chamber in conjunction with the casing, the flanks of the pinion teeth comprising at least three skewed surfaces which intersect in at least two edges.

4 Claims, 20 Drawing Figures

INTER-ENGAGING THREADED ROTOR AND PINION MACHINE WITH MULTI-EDGED PINION TOOTH FLANKS

The present invention relates to a compressor or expansion machine for fluids.

U.S. Pat. No. 3,932,077 aims to enable the manufacture of a gear for a compressor or an expansion machine, said gear comprising a screw with a plurality of threads which cooperate with the teeth of a pinion, each tooth flank being at least partially located on a surface of revolution. FIG. 1 of the accompanying drawings shows an apparatus in conformity with French Pat. No. 2,177,124. Unless otherwise specified, the sectional views of teeth are in a plane transverse to the tooth.

Referring to FIG. 1, there is shown a sectional view of tooth pinion 1, faces 2*a* and 2*b* of said tooth pinion cooperating with thread flanks 3*a* and 3*b* of threads 4*a* and 4*b*. The flanks are partially located on surfaces of revolution as shown in the sectional view by circles 5*a* and 5*b*. Face 6 of the tooth is on the pressure side and cooperates with a lip 7 of the groove of the casing 7*a* inside which the tooth is located during the compression or expansion cycle so as to provide relatively good tightness, the lip being represented by a broken line.

The hatched surfaces 8*a* and 8*b* in the sectional view show the existence of a gap between the thread flank, the casing surface and the tooth flank, resulting in a leak which will appear at the intersection of the screw and the casing. U.S. Pat. No. 3,932,077 indicates how to machine the screw so as to obtain the proper profile with a milling cutter or a grinder with the cutter or grinder moving between the threads. This proposal offers the advantage of spreading the zone of contact between the screw and the pinion over a greater area—much larger than when the zone is just a line—resulting in less wear and longer working life.

Furthermore, leakage is less than in the case of contact between an edge and a surface, the contact being between two tangential surfaces. Nevertheless, this solution presents two drawbacks:

(i) whenever the profiles are on parallel cylinders, which is the easiest solution for machining, the leaks through areas 8*a* and 8*b* may become major.

(ii) the thread machining takes a very long time because the diameter of the rotating cutting tool used is less than the width of the grooves between two adjacent threads and the chips' output is less than for other known proposals (see for example FIG. 2).

FIG. 2 of the accompanying drawings shows a proposal previously presented in U.S. Pat. No. 3,932,077.

In this case, the flanks of tooth pinion 1 comprise skewed surfaces, presented in sectional view, the surfaces being formed by almost straight lines 9*a*, 10*a*, and 9*b*, 10*b* which intersect as edges in sectional view, represented by 11*a* and 11*b*.

A skewed surface comprises elements of lines on a curve, which curve may or may not be a straight line. In fact, the flank tooth surfaces are not necessarily skewed surfaces by reason of the fact that the contact area of the pinion is so small that the tangent to the curve can be assimilated to the curve. A plane being transverse to the tooth at any given point of the flank is defined as a plane containing a vector parallel to the pinion rotation axis and the speed vector of the point as the pinion rotates. However, the error is not significant if a plane which is slightly different from the theoretical plane is selected; for example, a plane being parallel to the axis and containing two points on both flanks of a tooth and the plane being at equal distance from the centre, as shown in FIG. 5 of the accompanying drawings, referred to hereinafter. The proposal represented in FIG. 2 allows machining by a scoop tool as disclosed in British Pat. No. 649,412 or in U.S. Pat. No. 4,222,691 in the case of compressors with cylindrical pinions which require cutting with a tool holder, the dimensions of the tool holder not being limited by the width of the groove and allowing a greater output of chips, a greater rigidity and, therefore, more accurate work. Furthermore, the area of the triangles 11*a* and 11*b* can be reduced by having the edges 11*a* and 11*b* closer to the side 7.

The major drawback of the proposal is illustrated in FIG. 3 of the accompanying drawings. Slopes 9*a* and 10*a* are a function of the angle t, the angle t being the angle of the thread with respect to a line perpendicular to the lip 7 in a plane which is transverse to the pinion tooth, the angle t depending upon the tooth position. In some instances, the thread flank is on an intermediate position and the edge 11*a* will become rounded off to follow the profile 13 due to vibrations and some minor geometrical errors. Therefore, there is generated between the thread and the tooth flank some play 14 which can decrease the output of the machine.

It is an object of the present invention to overcome or at least mitigate some or all of the aforementioned difficulties and disadvantages.

According to the present invention there is provided a compressor or expansion machine for fluids, which comprises a rotor which is rotatable about an axis of rotation and which is provided with at least one thread in a helix at least partially around the rotor, the crest of the thread being disposed on a surface of revolution about the rotor axis, a casing at least partially surrounding the rotor, at least one pinion which is rotatable about an axis which is not parallel to the rotor axis, the pinion having teeth which cooperate through the tips and flanks thereof with the threads to form a compression or expansion chamber by means of two consecutive threads and the casing, the chamber having teeth flanks of the pinion comprising at least three skewed surfaces which intersect with at least two edges.

Hence, a thread can be machined with a cutter as disclosed in British Pat. No. 649,412 or U.S. Pat. No. 4,222,691, to minimize the leaks through areas such as 12*a* and 12*b*, whilst the contact area between the threads and the teeth flanks is increased and, at the same time, the edges are significantly rounded and leaks at 14 are reduced.

There need not be too many edges because results are usually acceptable with two edges.

The invention is applicable to gears comprising a screw in cooperation with at least one pinion regardless of the screw profile, in particular cylindrical, conical or in a plane, and of the shape of the high-pressure teeth flanks, in particular planar, conical or cylindrical.

An interesting feature of the invention occurs when the screw thread intake parts—that is, the thread area with which the pinion teeth flanks start to contact at the beginning of compression—correspond with the extreme values of the slope; in other words, the thread flank contact areas where angle t at one point of the pinion tooth flanks reaches minimum or maximum.

In changing the location of one of the pinion edges with respect to the location of the edge during the machining, some play is created between the pinion tooth flank and the thread. This play does not affect the output by reason of the fact that it occurs in an area of low pressure. Nevertheless, the play gives the advantage that, in the case of a machine with cylindrical screws and pinions, the pinion tooth will contact the thread on its tip rather than on its root, the tip being soft and absorbing shocks which occur whenever the tooth is not in its theoretical location. This advantage is additional to the reduction of the rounding of the edge and in some cases permits decrease of leaks by one-half.

For an apparatus with flat or conical screws, the extreme values of the screws being on the screw periphery, there is no contact at the periphery where maximum speed is reached and the meshing between the tooth and the thread flank is gradual, thereby eliminating shocks.

For a better understanding of the present invention and to show how the same may be carried into effect, reference will now be made, by way of example, to the accompanying drawings, in which.

Figure 5:
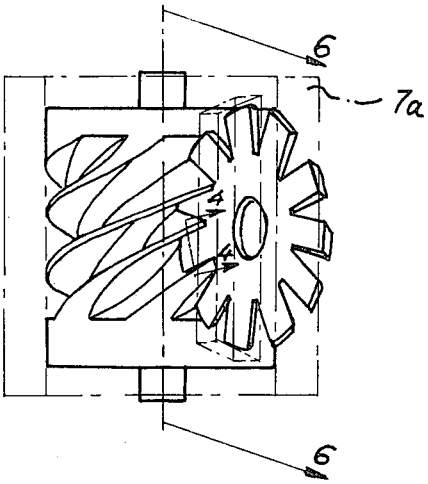
Figure 6:
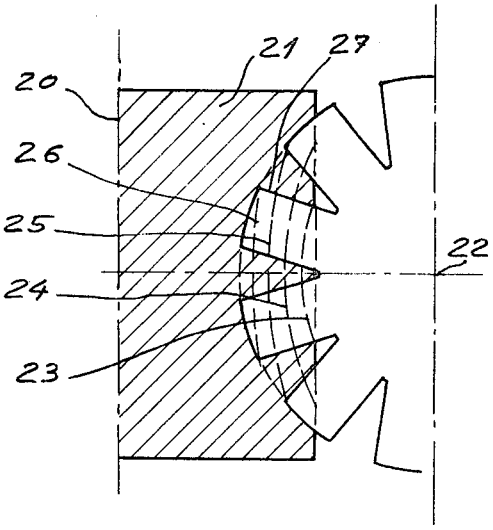
Figure 7:
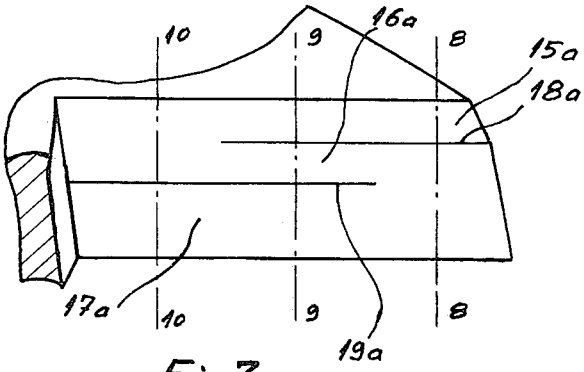
Figure 9:
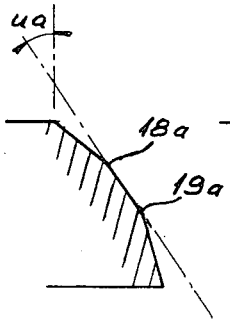
Figure 10:
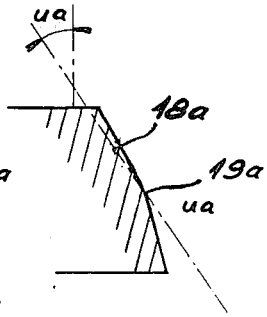
Figure 11:
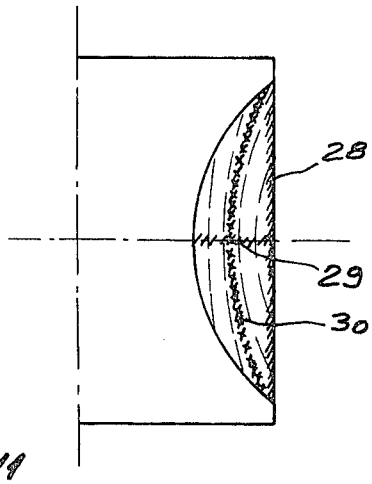
Figure 12:
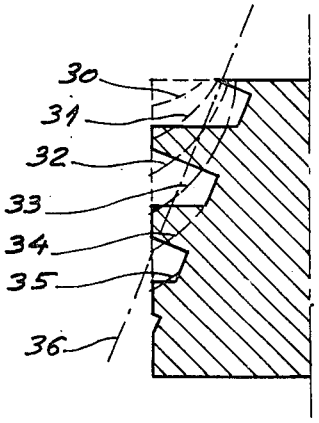
Figure 13:
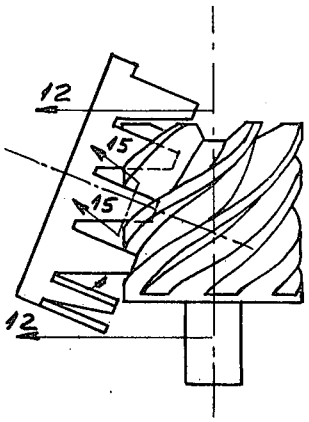
Figure 14:
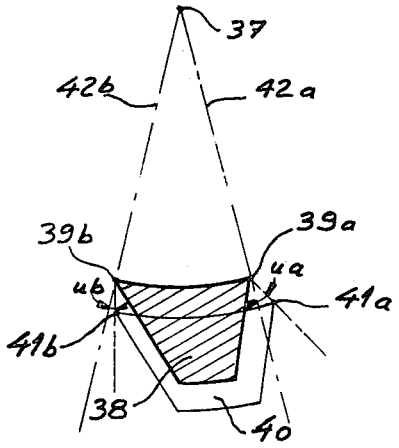
Figure 15:
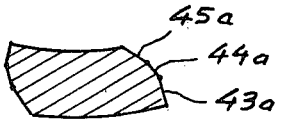
Figure 16:
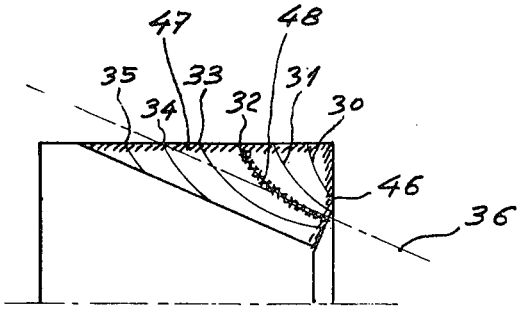
Figure 17:
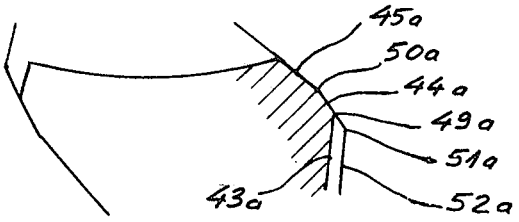
Figure 18:
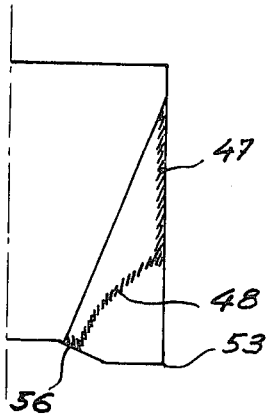
Figure 19:
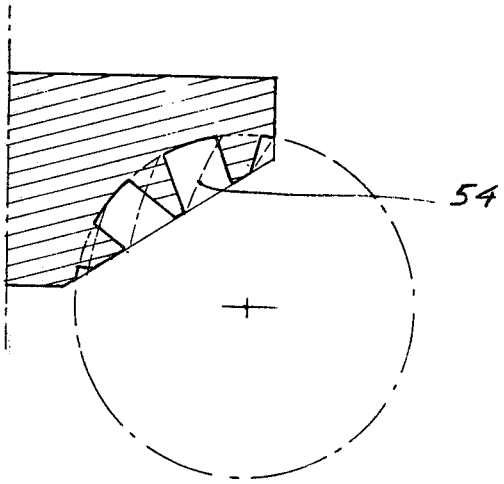
Figure 20:
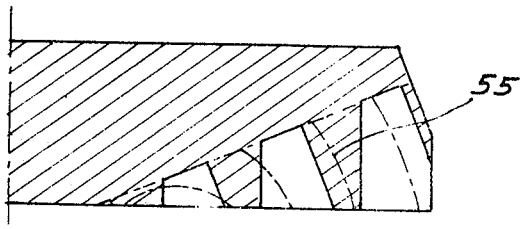

FIG. 5 shows a schematic perspective view of a cylindrical screw cooperating with a flat pinion, in accordance with the present invention, FIG. 6 shows a sectional view taken along line 6—6 of FIG. 5, FIG. 7 shows a perspective view of the pinion tooth flank of FIG. 6, FIGS. 8, 9 and 10 show sectional views taken along lines 8—8, 9—9 and 10—10, respectively, of FIG. 7, FIG. 11 shows a simplified representation of FIG. 6, showing contact zones between the screw and the pinion, FIG. 12 shows a sectional view taken along line 12—12 of FIG. 13, FIG. 13 shows a schematic perspective view of a cylindrical screw cooperating with a cylindrical pinion, in accordance with the present invention, FIG. 14 shows the cutter positions to machine the screw shown in FIGS. 12 and 13, FIG. 15 shows a sectional view of a pinion tooth taken along line 15—15 of FIG. 13, FIG. 16 shows a simplified representation of FIG. 13, showing contact zones between the screw and pinion, FIG. 17 shows a variation of the sectional view of FIG. 15, FIG. 18 shows a simplified representation of FIG. 17, showing contact zones between the screw and pinion, FIG. 19 shows a sectional view, similar to FIGS. 6 and 12, showing a conical screw and a flat pinion with drawing of isocline lines, and FIG. 20 shows a sectional view similar to FIGS. 6, 12 and 19 showing a flat screw and a cylindrical pinion with drawing of isocline lines.

Figure 4:
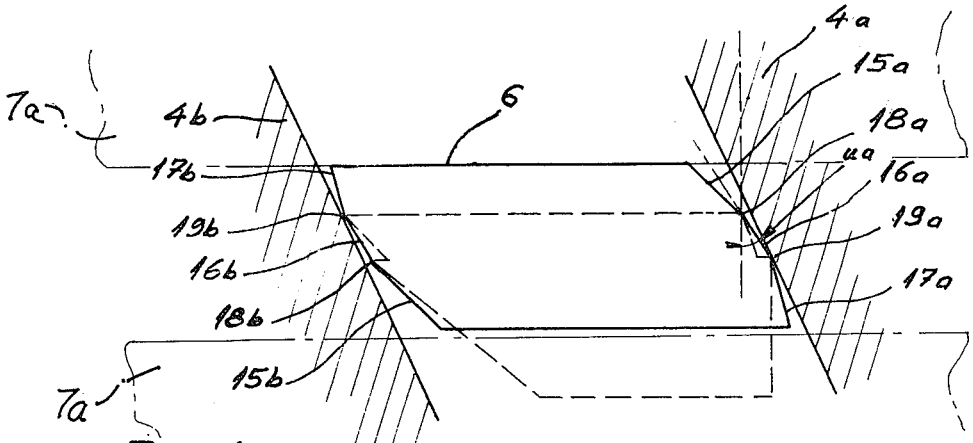
FIG. 4 shows a sectional view taken along line 4—4 of FIG. 5.

Referring now to the drawings, FIG. 4 shows a sectional view taken along line 4—4 of FIG. 5 of a pinion tooth according to the invention and of the thread flanks in contact with the tooth. It will be seen that the pinion flanks comprise approximately linear profiles in sectional view, profiles 15*a*, 16*a*, 17*a* and 15*b*, 16*b*, 17*b* intersecting in edges 18*a*, 19*a* and 18*b* and 19*b*. The broken line represents the section of a cutter to machine the screw fitting the pinion, as explained in British Pat. No. 649,412. The cutter has edges on each side which coincide with the pinion edges 18*a*, 19*a*, 18*b*, and 19*b*. ua is the slope of the line to connect 18*a* and 19*a* and ub is the slope of the line, not shown, to connect 18*b* and 19*b*.

It will be seen that the invention would not be affected if, instead of using the cutter illustrated in FIG. 4, the cutting were to be done successively with two different cutters each having only one edge on each side, that is the first edge connecting 18*a* and 18*b* and the second edge connecting 19*a* and 19*b*. FIG. 5 shows a cylindrical screw cooperating with a flat pinion, the screw and pinion having their tooth flanks in conformity with the invention. The screw and pinion rotate in a casing with a place for the pinion and high and low-pressure orifices (not shown).

FIG. 6 shows a sectional view taken along line 6—6 of FIG. 5 with respresentation of the screw 21, axis 20 and the pinion axis 22. The broken lines 23, 24, 25, 26 are the lines where the pinion flanks meet thread angles t of like value. The lines will hereafter be called isocline lines. For example, isocline line 24 is the locus of points where t is equal to 25°. Interference will be avoided if the slope of the pinion flanks at any given point is outside angle values of extreme isocline lines, that is, be equal to or greater than the highest slope and equal to or less than the lowest slope.

Figure 8:
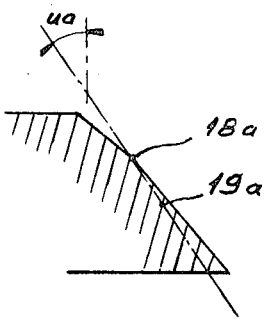

FIG. 7 shows a perspective view of a tooth flank such as 27 where one can see the edges 18*a* and 19*a* resulting from the intersection of surfaces 15*a*, 16*a* and 17*a*. FIGS. 8, 9 and 10 show sectional views of FIG. 7 along the lines 8—8, 9—9 and 10—10, respectively. It is obvious that there are three zones alongside the flank. FIG. 8 shows the zone where the tooth flanks meet only isocline lines where t is always greater than ua, FIG. 9 shows the zone where $t=ua$ and FIG. 10 shows where the flanks make contact only with points whose slopes are less than ua.

It will be observed that the edges 18*a* and 19*a* are linear and lie in parallel planes in the aforementioned example, but the features are not essential to the invention by reason of the fact that the edges can be machined non-linear and/or not parallel with shaped tools without impairing the results of the invention.

Figure 1:
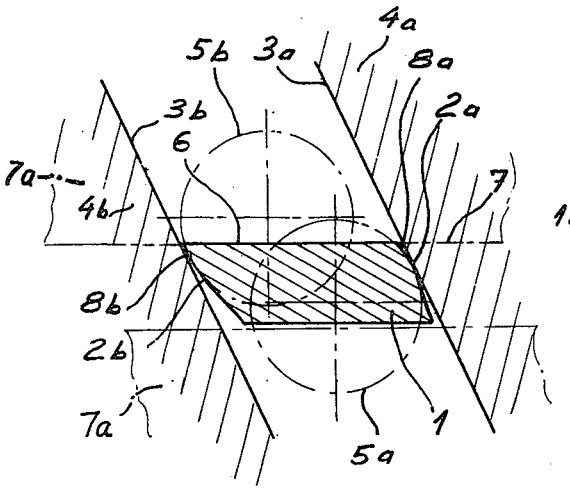
Fig. 1 PRIOR ART
FIGS. 1 and 2 show sectional views of a pinion tooth between thread flanks, according to the prior art.
Figure 2:
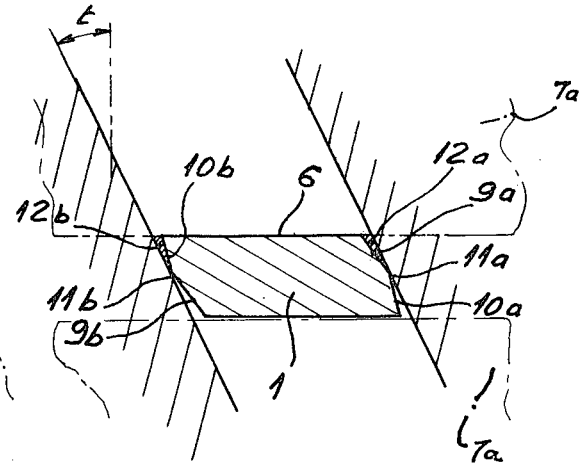
Fig. 2 PRIOR ART

The hatched areas 28 and 29 in FIG. 11 represent the zones where the slopes reach an extreme, a minimum or a maximum during the path of a point of the flank. Whenever the thread flank is composed of two areas intersecting in an edge as shown in FIG. 2, each of said areas makes contact on the thread flank in the hatched area. During the remainder of the path, the contact between the face and the thread is through the edge. An edge does not offer any wear resistance; therefore, the driving of the pinion by the screw is effected only over the hatched areas. In the tooth shown in FIGS. 4 to 10, there is an additional contact zone 30, the zone being represented by a double hatched surface on FIG. 11 and meeting the isocline line where $t=ua$.

Therefore, the result is that the contact area on the thread is larger and that a tooth flank always has two contacts on surfaces (as opposed to contacts on edges) instead of only one in the case of a single edge and it can withstand, without any major wear, higher lateral stresses. Finally, it results in the obtuse angle of each edge being closer to 180° than a single edge would be by reason of the fact that one goes from one extreme slope to another through an intermediate slope, said intermediate slope being equal to ua.

Figure 3:
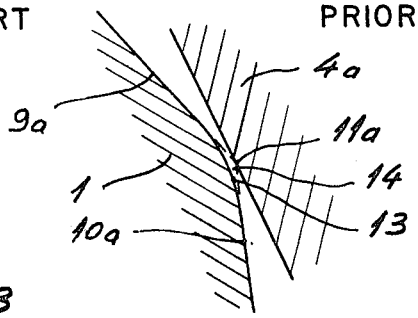
Fig. 3 PRIOR ART
FIG. 3 is a partial enlarged view of the pinion tooth shown in FIGS. 1 and 2.

If one assumes that the edge curvature is relatively constant regardless of the edge angle, it will be seen that the reduction of the gap 14 shown in FIG. 3 will decrease with the square of the angle difference. For example, a screw having a diameter of 100 mm and having six threads meshing with a pinion, the pinion having eleven teeth with a diameter of 100 mm and axes which are at a distance of 80 mm, presents angles t whose minimum values from the base of the tooth to its tip vary between 17° and 28° for the lowest slope and between 17° and 42° for the highest slope. If ua=28°, the tooth contacts the thread on two points during the trajectory and, in the middle of the tooth, the slope differences, which amounted to 8° for a single edge, are reduced to about 4°.

The advantage of the decrease in the edges' angles is even more noticeable in cylindrical screws meshing with cylindrical pinions as described in U.S. Pat. No. 3,551,082.

FIG. 12 shows a sectional view along the line 12—12 of FIG. 13 of a cylindrical screw in conformity with French Pat. No. 1,586,832 showing isocline lines for the following: screw with six threads, pinion with seventeen teeth, screw diameter: 56 mm, pinion diameter at contact: 74 mm, axes angle: 65° and axis dimension: 35 mm. The isocline lines 30, 31, 32, 33, 34 and 35 correspond to −5°, 0°, 10°, 20°, 30° and 40° angles.

The broken line 36 shows the locus of a point on a tooth flank which is approximately a straight line. The differences among slopes of isocline lines met by a point are quite noticeable with an average of 20°, thereby leading to a quite prominent edge. Therefore, the intention of the invention to use a flank profile with two or three edges significantly decreases the edge angle and the ensuing play.

FIG. 14 shows the position of tools to machine a two-edge profile as described in the U.S. Pat. No. 4,222,691. The centre of the cutter holder which rotates with a pre-set speed with the screw thereby progressively cutting to obtain the threads is shown at 37. The hatched surface 38 represents a sectional view of a cutting tool. Tool edges 39*a* and 39*b* correspond to one of the two edges of the pinion tooth flanks. The other sectional view (without any hatched surface) shows a second tool 40 mounted on the aforementioned tool holder—or on another holder used for a second machining—the edges 41*a* and 41*b* of the tool holder being staggered with respect to the edges 39*a* and 39*b*. The lines connecting points 39*a*, 41*a* and 39*b*, 41*b* make angles ua and ub with vectors 42*a* and 42*b*.

FIG. 15 shows a sectional view of a pinion tooth along line 15—15 of FIG. 13 and along line 36 of FIG. 12.

Each flank presents three slopes:

slope 43*a* is the thread slope at start of engagement, approximately the value of isocline line 31, slope 44*a* is similar to value ua, slope 45*a* approximates to the value of isocline line 34.

The three slopes correspond to the three zones on the thread where the zone of contact is similar to that which has been described in relation to FIG. 11 and which is shown in FIG. 16, with a zone 46 having a mininum slope along the line of trajectory such as 36, a zone 47 where slope is maximum and a zone 48 which follows an isocline line, the slope of which is equal to ua. Therefore, through the adjunction of another edge, the zone of contact can be increased, such zone being determined by the angle ua. The angle can be changed by moving the tool with respect to the position of first cutter during the cutting operation. Nevertheless, it is easier to keep a linear plunge feed and to keep ua constant.

A variation of the invention can be accomplished by staggering one of the pinion edges with respect to its corresponding position on the screw. FIG. 17 shows a sectional view of a pinion tooth profile with slopes 43*a*, 44*a* and 45*a* intersecting along edges 49*a* and 50*a*. The screw thread flank is machined by two cutters. The edge of one coincides with edge 50*a*, but the edge of the other is 51*a* on the extension of the slope connecting 49*a* and 50*a*. The lines 45*a*, *44a* and 52*a* represent the envelope of the threads with respect to the pinion tooth. Therefore, there is no contact between the thread and the pinion tooth for all the thread flank zones where lines 43*a* and 52*a* are spaced, that is, whenever the slope alongside the thread flank is less than ua. FIG. 16 shows that, whenever the slope of the isocline lines is less than that of the isocline 32, there is no contact, that is, on the entire thread surface on one side of the isocline line 32 and containing the lines 31, 30 etc . . .

The contact zone between the screw and the pinion is limited to zones 47 and 48, as indicated in FIG. 18.

Therefore, some play between tooth and thread will result, this play being noticeable between lines 52*a* and 43*a*. The play will occur when the thread slope is less than ua and the slope will decrease as the slope 52*a* rotates around the edge 51*a*. The play will disappear when the thread slope equals ua and when 52*a* coincides with the line connecting 49*a* and 50*a*.

Point 51*a* which results from the intersection of the axis of the two edges in a plane transverse to the pinion tooth is located outside of the tooth flank and the other coincides with edge 50*a* of the pinion tooth flank. The sections of edges 49*a*, 50*a* and 51*a* are visibly aligned.

The play is maximum at 53 according to the isocline lines and progressively decreases as the zone 48 becomes nearer. However, the zone corresponds to the start of the compression cycle or to the end of the expansion cycle and leaks are small as long as the distance between points 49*a* and 51*a* remains small, for example, 0.3 mm in the aforementioned example.

In the case of a compressor, the advantage is that the tooth starts to mesh with the thread in zone 56, the zone being in contact with the tip of the tooth. The tooth tip is more flexible than its root by reason of the fact that the teeth are normally made of plastics material and slide on a metallic support. Due to vibrations and to small design errors during fabrication, the tooth is not always at the correct position. During acceleration or slow-down as the tooth contacts the thread, the variations will be better absorbed whenever the contact is made through the tip rather than through the root. Therefore, wear is reduced and, in conjunction with less play between the edges, remarkable results are obtained. On compressors having the aforementioned dimensions, the unit being a millimeter, the leak is reduced by one-half and the number of revolutions to obtain a zero output is decreased from 1200 to 600 rpm.

The previous results are attainable because the thread intake, that is the thread zone with which the teeth start to cooperate during a compression cycle, is on a slope of extreme value, that is a zone where the slope alongside the locus of a tooth face point, as illustrated in FIG. 16, reaches a maximum or minimum value. Otherwise, if an isocline line were to cut the trajectory twice, some play would result at another point most likely at high pressure and the resulting leaks would not be minor. Therefore, this solution is not advised for an apparatus as illustrated in FIGS. 5 to 11, but the solution does apply to conical or flat screws which cooperate with flat pinions or to conical or flat screws which cooperate with cylindrical pinions, the shape of the isoclines being illustrated in FIGS. 19 and 20 by lines 54 and 55.

Considering ua as the slope value of the isocline line 54 (or 55), one can be sure there is no contact before the tooth reaches the isocline line 54 (or 55). Hence, the contact is graduated as the play between lines 52*a* and 43*a* is progressively reduced; consequently, shocks are absorbed and, as shown in FIG. 19, the meshing is effected through the flexible tooth tip. The same considerations apply for the other flank even if ub differs from ua and if the dimension between edges 49*a* and 51*a* is different. The description concerning two edges can be applied to a plurality of edges.

The fabrication of pinion flanks has not been described. In fact, the pinion flanks can be obtained by many processes, such as moulding or grinding.

To obtain double edges for cylindrical pinions as shown in FIGS. 17 and 18, one can take pinions having trapezoidal teeth and one edge per side such as 50*a* and push the pinion in the screw during operation. Wear of the flank will result in an angle where slope ua has two edges. The desired play such as illustrated in FIG. 17 between 52*a* and 43*a* will be maintained by stopping the feed at the desired time.

The advantages provided by the invention can also be obtained by limiting its application only to the trailing flank.

The trailing flank is defined as the pinion tooth flank which is pushed by the screw threads as the rotation of the pinion is slowed down.

For a compressor, this flank is designated by the letter a (i.e., ua, 8*a* . . . ) and for an expansion machine by the letter b (i.e., ub, . . . ).

Whatever care is taken during fabrication, it appears very difficult to avoid the pinion being slowed down by friction and, unless the engine is slowed down to stop or to change speed, the other flank is not affected and can have only one edge without impairing the performance of the machine.

It is, therefore, essential to ensure that deceleration of the machine is no more rapid than deceleration which is caused by natural friction which affects the pinion. Therefore, it is advisable to have at least two edges on the other flank.

I claim:

1. In a machine for treating a fluid in a manner selected from compressing and expanding, comprising a rotor rotatable about an axis of rotation, a casing at least partially surrounding the rotor and at least one pinion which rotates about an axis which is not parallel to the rotor axis, said machine comprising at least one thread in a helix at least partially round the rotor, the crest of the thread being disposed on a surface of revolution about the rotor axis, the pinion having teeth which cooperate through the tips and flanks thereof with the threads to form a chamber by means of two successive threads and the casing, the improvement wherein at least the trailing teeth flanks of the pinion comprise a skewed surface provided with at least two edges extending along at least a part of the length of said flanks, said edges being located in front of each other along at least a part of their length.

2. The machine of claim 1, in which each of the trailing and leading teeth flanks of the pinion have a skewed surface provided with at least two edges extending along at least a part of the length of said flanks, said edges being located in front of each other along at least a part of their length.

3. The machine of claim 1, in which the edges of a flank are linear and lie in parallel planes.

4. The machine of claim 1, in which the thread intakes of the screw threads coincide with extreme slope values, the screw thread flanks cooperate with the pinion teeth trailing flanks, the screw flanks are generated by at least two edges with one of said two edges coinciding with a first edge on the pinion tooth flank, the other of said two edges being part of a skewed surface containing the first edge and a second pinion flank edge, but located outside the interval between said first and second pinion flank edges.

* * * * *